US009384694B2

(12) United States Patent
Guo et al.

(10) Patent No.: US 9,384,694 B2
(45) Date of Patent: Jul. 5, 2016

(54) DISPLAY PANEL AND DRIVING METHOD THEREOF

(71) Applicant: AU Optronics Corporation, Hsin-Chu (TW)

(72) Inventors: Ting-Wei Guo, Hsin-Chu (TW); Yu-Sheng Huang, Hsin-Chu (TW); Ya-Ting Lin, Hsin-Chu (TW); Chun-Pin Fan, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 14/556,660

(22) Filed: Dec. 1, 2014

(65) Prior Publication Data

US 2015/0310802 A1 Oct. 29, 2015

(30) Foreign Application Priority Data

Apr. 23, 2014 (TW) ..... 103114712 A

(51) Int. Cl.
*G09G 5/00* (2006.01)
*G09G 3/32* (2016.01)

(52) U.S. Cl.
CPC ..... *G09G 3/3233* (2013.01); *G09G 3/3291* (2013.01); *G09G 2300/0819* (2013.01); *G09G 2300/0842* (2013.01); *G09G 2300/0861* (2013.01); *G09G 2300/0866* (2013.01);
(Continued)

(58) Field of Classification Search
CPC ..... G09G 3/3233; G09G 3/3291; G09G 2300/0426; G09G 2300/043; G09G 2300/0819; G09G 2300/0842; G09G 2310/0202; G09G 2320/0219
USPC ..... 345/76, 78, 211–215, 690; 315/228; 313/504
See application file for complete search history.

(56) References Cited

U.S. PATENT DOCUMENTS 5,828,357 A * 10/1998 Tamai ..... G09G 3/2011 345/210
8,368,629 B2 * 2/2013 Jung ..... G09G 3/3688 345/204

(Continued)

FOREIGN PATENT DOCUMENTS

CN 101859539 10/2010
TW I402803 7/2013

OTHER PUBLICATIONS

Soo-Yeon Lee et al., "4.0-in. High Definition AMOLED Panel Employing Simultaneous Emission Driving Method", SID 2012 Digest, pp. 195-198.

*Primary Examiner* — Prabodh M Dharia
(74) *Attorney, Agent, or Firm* — WPAT, PC; Justin King; Douglas A. Hosack

(57) ABSTRACT

A display panel includes a control circuit and a pixel structure. The control circuit selectively provides a data signal or a first reference voltage signal. The pixel structure includes a capacitor, a first, a second and a third switch unit. For the first switch unit, a first and a second terminal are coupled to two the capacitor in series, and a control terminal receives a control signal. For the second switch unit, a first terminal is coupled to the second terminal of the first switch unit, and the control terminal receives a first scan signal. For the third switch unit, a first terminal receives the data or first reference voltage signal, a second terminal is coupled to the second terminal of the second switch unit and a light emitting element, and the control terminal is coupled to the second terminal of the first switch unit.

19 Claims, 11 Drawing Sheets

(52) U.S. Cl.
CPC ..... *G09G2310/0262* (2013.01); *G09G 2310/0297* (2013.01); *G09G 2320/043* (2013.01)

(56) References Cited

U.S. PATENT DOCUMENTS

| | | | | |
|---|---|---|---|---|
| 8,648,848 | B2 | 2/2014 | Tsai et al. | |
| 8,723,763 | B2 * | 5/2014 | Jeong | G09G 3/3233 345/82 |
| 2004/0145547 | A1 | 7/2004 | Oh | |
| 2007/0063935 | A1 * | 3/2007 | Yoshida | G09G 3/325 345/76 |
| 2008/0054798 | A1 * | 3/2008 | Jeong | G09G 3/006 313/504 |
| 2010/0311502 | A1 * | 12/2010 | Miller | G07F 17/3293 463/30 |
| 2012/0019498 | A1 * | 1/2012 | Jeong | G09G 3/3233 345/211 |
| 2012/0026145 | A1 * | 2/2012 | Jeong | G09G 3/3233 345/211 |
| 2012/0105408 | A1 * | 5/2012 | Kang | G09G 3/3225 345/211 |
| 2012/0147060 | A1 * | 6/2012 | Jeong | G09G 3/3233 345/690 |
| 2012/0212476 | A1 * | 8/2012 | Yamauchi | G09G 3/3614 345/212 |
| 2013/0100173 | A1 * | 4/2013 | Chaji | G09G 5/10 345/690 |
| 2013/0169170 | A1 | 7/2013 | Shih | |
| 2014/0084805 | A1 * | 3/2014 | Kim | G09G 3/2048 315/228 |
| 2014/0354711 | A1 * | 12/2014 | In | G09G 3/3233 345/691 |

* cited by examiner

DISPLAY PANEL AND DRIVING METHOD THEREOF

RELATED APPLICATIONS

This application claims priority to Taiwan Application Serial Number 103114712, filed Apr. 23, 2014, which is herein incorporated by reference.

BACKGROUND

1. Field of Invention

The present disclosure relates to a display panel. More particularly, the present disclosure relates to a pixel structure of a display panel and a driving method thereof.

2. Description of Related Art

Flat panel display has been the mainstream in display technology and been applied to most of the displays of mobile devices, computers, televisions, etc. The flat panel display is sorted into groups, e.g., a liquid display, a plasma display and an organic light emitting diode display, in which the liquid display and the organic light emitting diode display are the primary types of the flat panel displays.

Normally speaking, the liquid displays are equipped with light emitting diodes backlit (LED-backlit) modules which is more energy economic. The LED-backlit modules needs a driving circuit to drive the LEDs therein such that the liquid panel can generate the desired color using backlight from the LED-backlit module. On the other hand, the luminance of the organic light emitting diode is also adjusted by a driving circuit.

However, due to a certain time period of serving or the quality variation in the production process, the threshold voltage of transistors in the circuit is subjected to a shifting effect such that the driving circuit cannot effectively control the current flowed through the LED or the OLED, which makes luminance of each pixel not the same on the display.

Traditionally, as shown in FIG. 1, it is a circuit diagram illustrating a pixel structure 100 of a display panel. The pixel structure 100 includes 6 transistors and 2 capacitors so as to compensate the threshold voltage of the p-type transistor 101. As such, the current flows through the light emitting diode 102 but is not affected by the shifted threshold voltage. However, since the resolution of the display panel becomes higher and higher, and the amount of transistors and of capacitors in a single pixel are also getting larger, the total numbers of the transistors and capacitors in the display panel significantly increase, so does the manufacturing cost.

Therefore, there is need in lowering the cost of the pixel structure and compensating the shift of the threshold voltage.

SUMMARY

The disclosure provides a display panel. The display panel includes a control circuit and a pixel structure. The control circuit selectively provides a data signal or a first reference voltage signal. The pixel structure includes a capacitor, a first third switch unit, a second third switch unit and a third switch unit. The first switch unit includes a first terminal, a second terminal and a control terminal. The first terminal and the second terminal of the first switch unit are electrically coupled to two terminals of the capacitor respectively. The control terminal of the first switch unit receives a control signal. The first switch unit includes a first terminal, a second terminal and a control terminal. The first terminal of the second switch unit is electrically coupled to the second terminal of the first switch unit, and the control terminal of the second switch unit is configured to receive a first scan signal. The third switch unit includes a first terminal, a second terminal and a control terminal. The first terminal of the third switch unit is configured to receive the data signal or the first reference voltage signal, the second terminal of the third switch unit is electrically coupled to the second terminal of the second switch unit and to a first terminal of a light emitting element, and the control terminal is electrically coupled to the second terminal of the first switch unit.

The disclosure provides a pixel driving method which is suitable to be applied on the mentioned display panel. The pixel driving method includes the following steps: disconnecting a current transmission path from the third switch unit to the light emitting element; conducting the first switch unit by the control signal, which makes the control signal of the third switch unit have the initial voltage; conducting the second switch unit by the first scan signal, and conducting the third switch unit by the data signal and the initial voltage of the control terminal of the third switch unit such that the control terminal of the third switch unit generates a difference voltage according to the data signal and the threshold voltage of the third switch unit; conducting the current transmission path from the third switch unit to the light emitting element; and conducting the third switch unit by the difference voltage and the first reference voltage signal so as to output an output current through the current transmission path to the light emitting element.

It is to be understood that both the foregoing general description and the following detailed description are by examples, and are intended to provide further explanation of the invention as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
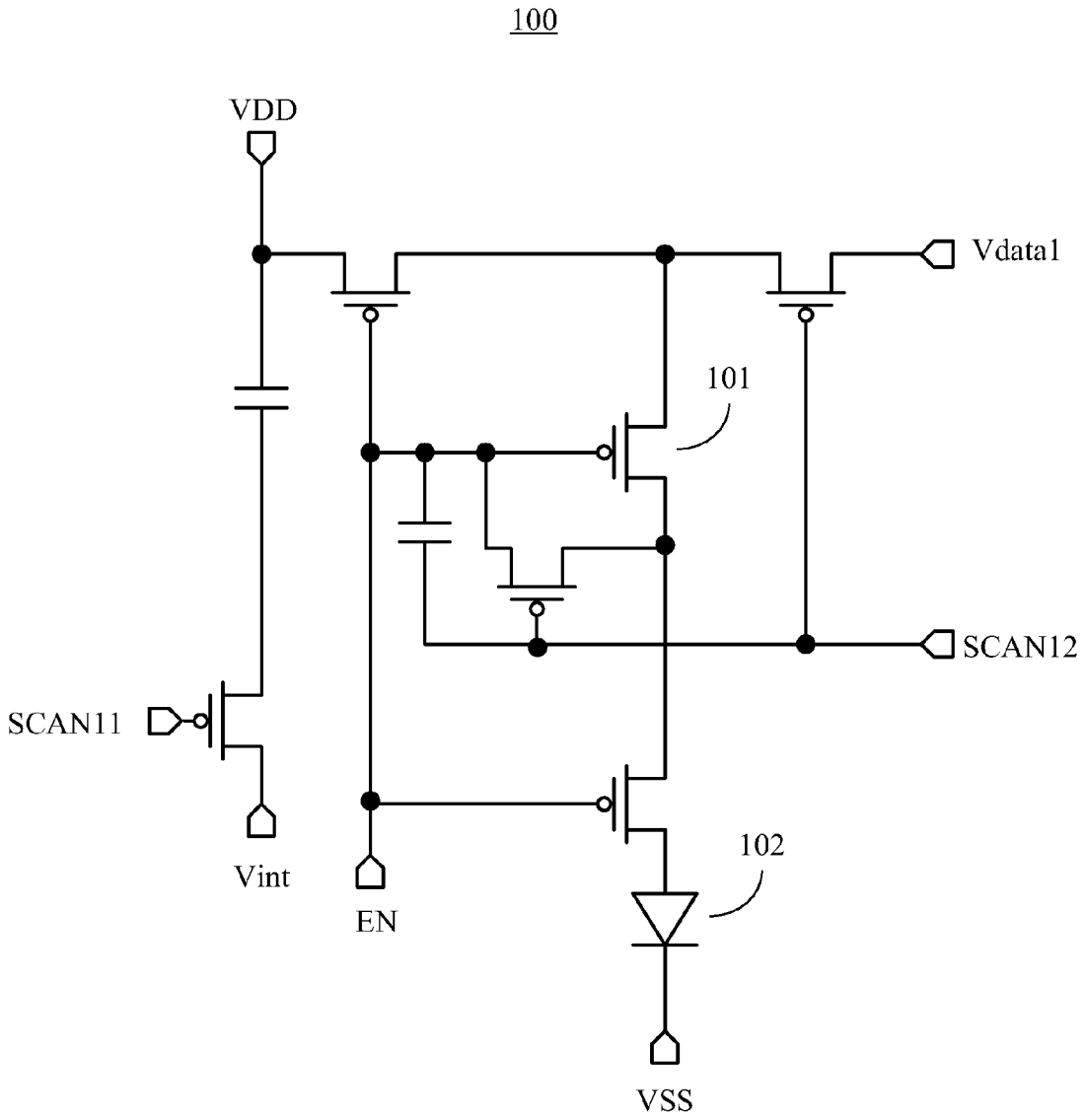
Fig. 1(Prior Art)
FIG. 1 is a circuit diagram illustrating a pixel structure of a display panel.

Reference will now be made in detail to the present embodiments of the disclosure, examples of which are illustrated in the accompanying drawings. Wherever possible, the same reference numbers are used in the drawings and the description to refer to the same or like parts.

It will be understood that, although the terms "first", "second," etc., may be used herein to describe various elements, these elements should not be limited by these terms. These terms are used to distinguish one element from another.

Figure 2A:
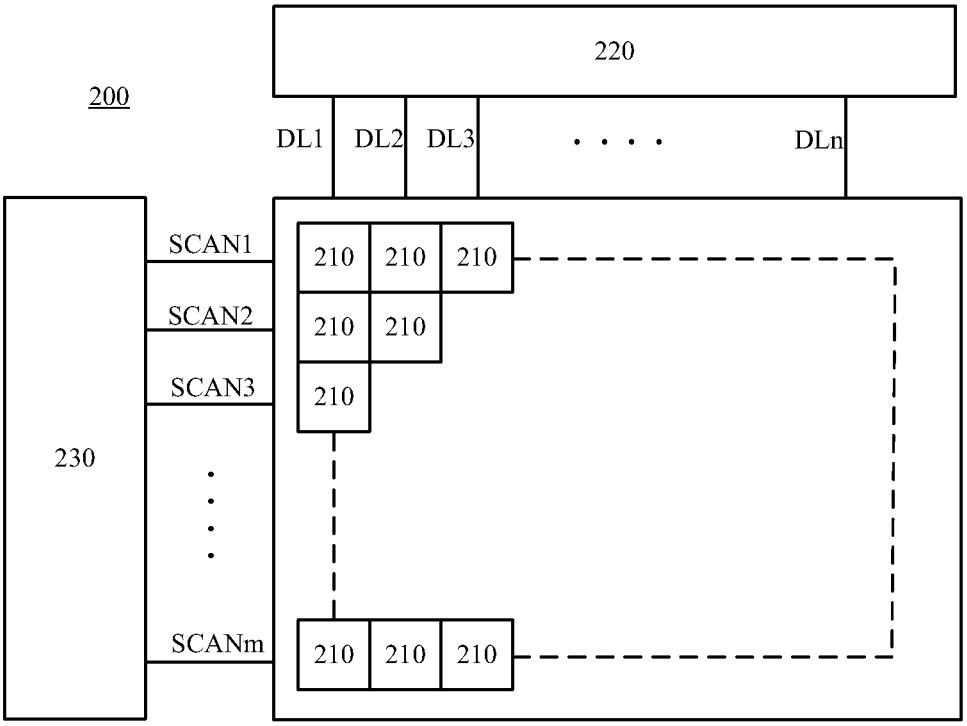
FIG. 2A is a schematic diagram illustrating a display panel according to one embodiment of the disclosure.

Referring to FIG. 2A, a schematic diagram illustrating a display panel 200 according to one embodiment of the disclosure is presented. The display panel 200 includes a plurality of pixel structures 210, a control circuit 200 and a scan circuit 230. The pixel structures 210 are electrically coupled to the control circuit 220 by data lines DL1-DLn, and the pixel structures 210 are electrically coupled to the scan circuit 230 by scan lines SCAN1-SCANm, in which the data lines DL1-DLn are configured to control the pixel structures 210 in the same column respectively, and the scan lines SCAN1-SCANm are configured to scan the pixel structures 210 in the same row respectively. For example, the data line DL1 controls all the pixel structures 210 in the first column, and the scan line SCAN1 scans the pixel structures in the same row. Therefore, the data line DL1 and the scan line SCAN1 is configured to control luminance of the pixel structure at the upper-left corner.

Figure 2B:
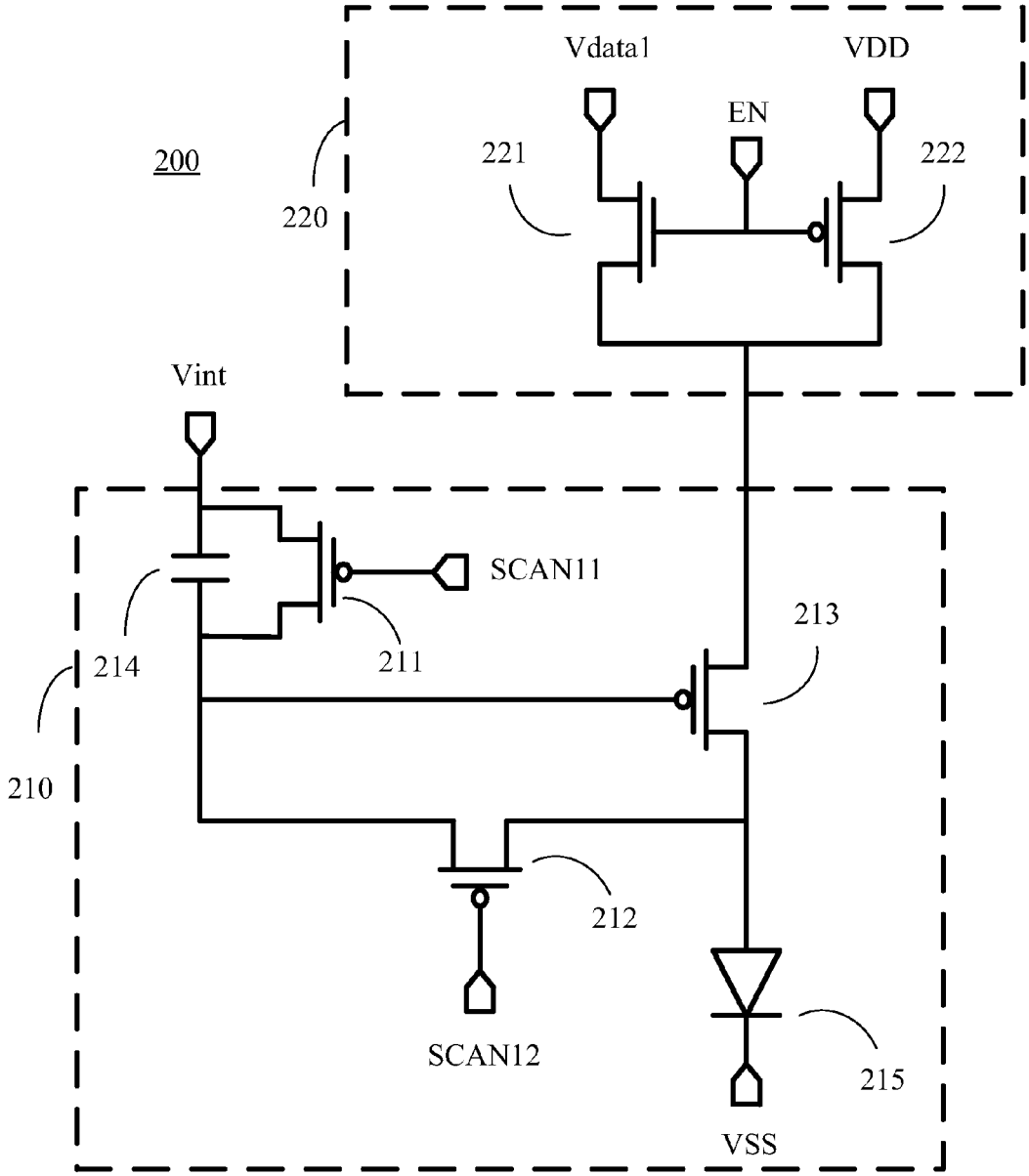
FIG. 2B is a circuit diagram illustrating a display panel according to one embodiment of the disclosure.

Referring also to FIG. 2B, a schematic diagram illustrating a display panel 200 according to one embodiment of the disclosure is presented. FIG. 2B is an example of the pixel structure 210 at the upper-left corner in FIG. 2A, but it is not limited to the certain pixel structure. As shown in FIG. 2B, the pixel structure 210 includes a transistor 211, a transistor 212, a transistor 213, a capacitor 214 and a light emitting element 215. The control circuit 220 includes a transistor 221 and a transistor 222. The transistor 211, the transistor 212, the transistor 213 and the transistor 222 may be p-type transistors as an example in the present embodiment, and the transistor 221 may be a n-type as an example in the present embodiment.

In some embodiments, the transistor 221 may be a p-type transistor, and the transistor 222 may be an n-type transistor.

A control terminal, e.g., a gate terminal, of the transistor 211 is configured to receive the scan signal SCAN11 transmitted by the scan line SCAN1. A first terminal, e.g., a source terminal, of the transistor 211 is configured to receive an initial voltage Vint and electrically coupled to a first terminal of the capacitor 214. A second terminal, e.g., a drain terminal, of the transistor 211 is electrically coupled to the second terminal of the capacitor 214 and a control terminal, e.g., a gate terminal, of the transistor 213.

The transistor 211 is the p-type transistor as an example in the present embodiment. When the scan signal SCAN11 is lower than a first voltage level, and when the transistor 212 is not conducted, the transistor 211 is conducted such that the control terminal of the p-type transistor 213 has the initial voltage Vint, in which the first voltage level is defined as the subtraction of the threshold voltage of the transistor 211 from the initial voltage Vint.

The control terminal, e.g., the gate terminal, of the transistor 212 is configured to receive the scan signal SCAN12 transmitted by the scan line SCAN1, the first terminal, e.g., the source terminal, of the transistor 212 is electrically coupled to the second terminal, e.g., the drain terminal, of the transistor 213 and the first terminal of the light emitting element 215. The second terminal, e.g., the drain terminal, of the transistor 212 is electrically coupled to the second terminal of the capacitor 214 and the control terminal of the transistor 213.

The first terminal, e.g., the source terminal, of the transistor 213 is electrically coupled to the control circuit 220, in which the transistor 213 selectively receives the data terminal Vdata1 and the reference voltage signal VDD from the control circuit 220. In more details, the control terminal, e.g., the gate terminal, of the transistor 221 and the control terminal, e.g., the gate terminal, of the transistor 222 are configured to receive the enable signal EN. The second terminal, e.g., the drain terminal, of the transistor 221 is configured to receive the data signal Vdata1. The first terminal e.g., the source terminal, of the transistor 222 is configured to receive the reference voltage signal VDD, the first terminal, e.g., the source terminal, of the transistor 221, and the second terminal, e.g., the drain terminal, of the transistor 222 are electrically coupled to the first terminal of the transistor 213.

When the transistor 221 is an n-type transistor, and the transistor 222 is the p-type transistor, the transistor 221 is turned on, and the transistor 222 is turned off in the situation that the enable signal En is equipped with an enable voltage level. As a consequence, the transistor 213 is configured to receive the data signal Vdata1, in which the enable voltage level may be a high voltage level as an example. On the other hand, when the enable signal EN has a non-enable voltage level, the transistor 222 is turned on, and the transistor 221 is turned off, which makes the p-type transistor 213 receive the reference voltage signal VDD in which the non-enable voltage level may be a low voltage level as an example.

In some embodiments, when the enable voltage level is the high voltage level, the enable voltage level of the enable signal EN is between the reference voltage level VDD and the second voltage level, in which the second voltage level is defined as the subtraction of the threshold voltage of the transistor 222 from the voltage level of the reference voltage signal VDD.

In some embodiments, when the non-enable voltage level is the low voltage level, the non-enable voltage level of the enable signal EN may be between the zero voltage level and the threshold voltage of the n-type transistor 221.

Moreover, when the transistor 213 receives the data signal Vdata1, and when the transistor 212 is conducted by the scan signal SCAN12 transmitted by the scan line SCAN1, the difference of the voltage level of the data signal Vdata1 and the threshold voltage of the transistor 213 is stored at the control terminal of the transistor 213.

The light emitting element 215 may be a light emitting diode or an organic light emitting diode. The second terminal of the light emitting element 215 is configured to receive the reference voltage signal VSS, in which variation of the voltage levels corresponding to the reference voltage signal VSS and to the enable single EN may be synchronized. In more details, when the transistor 213 is a p-type transistor, and when the transistor 221 is an n-type transistor, the reference voltage signal has the enable voltage level when the enable signal EN has the enable voltage level. In contrast, the reference voltage signal VSS has the non-enable voltage level if the enable signal EN has the non-enable voltage level, in which the non-enable voltage level may be the low voltage level.

In other words, when the transistor 213 receives the data signal Vdata1, i.e., the enable signal En has the enable voltage level, the reference voltage signal VSS has the enable voltage level, e.g., the high voltage level, which turns off the light emitting element 215. On the other hand, when the transistor 213 receives the reference voltage signal VDD, i.e., the enable signal EN has the non-enable voltage level, the reference voltage signal VSS has the non-enable voltage level, e.g., the low voltage level, such that the light emitting element 215 is not turned off. Therefore, compared to the pixel structure 100 shown in FIG. 1, the synchronized variation of the reference voltage signal VSS and the enable signal EN make the pixel structure 210 needless to dispose additional transistor such that the number of the transistors in the pixel structure 210 is reduced, in which the additional transistor is the transistor electrically connected to the first terminal of the light emitting element 102.

Figure 2C:
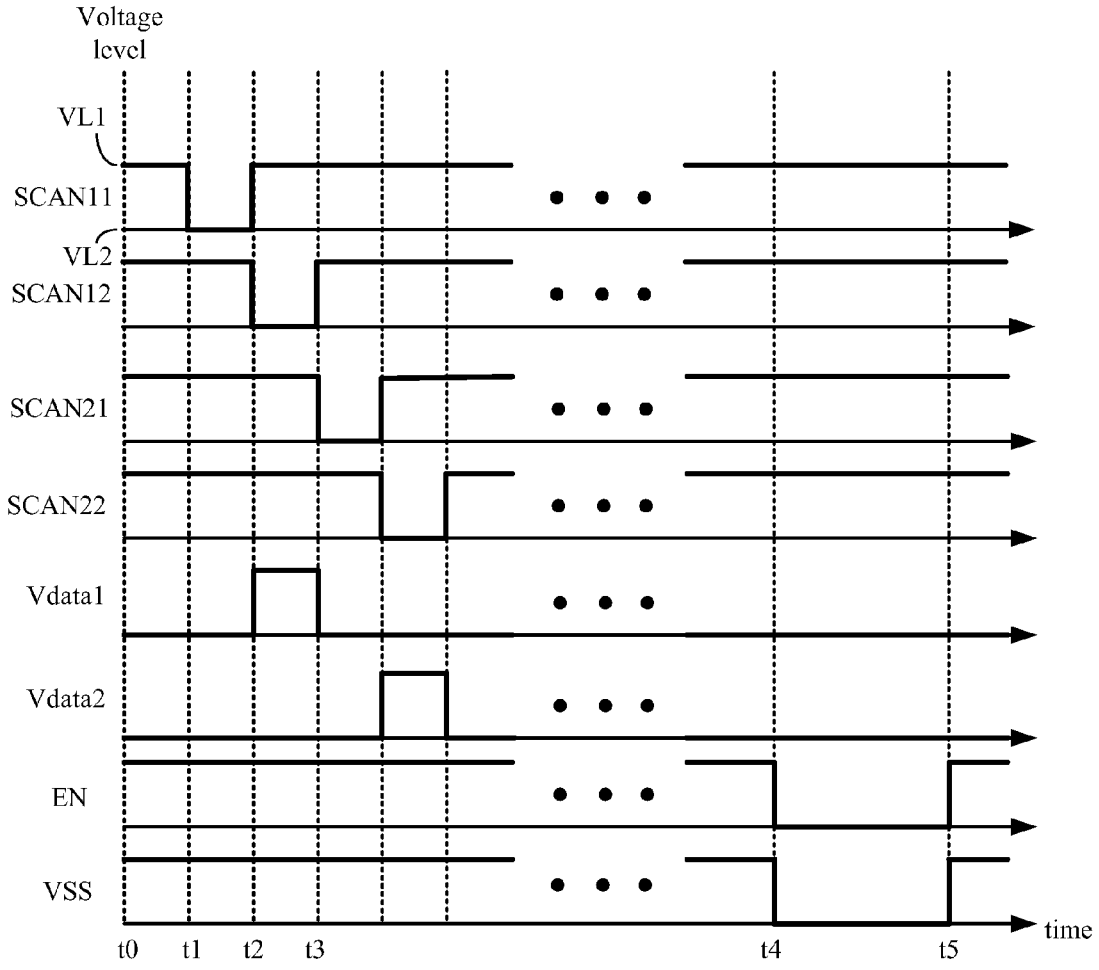
FIG. 2C is a timing diagram illustrating signals of the touch panel shown in FIG. 2B.

Referring also to FIG. 2C so as to illustrate the driving mechanism of the pixel structure 210 in the display panel 200 as shown in FIG. 2B. FIG. 2C is a timing diagram illustrating signals of the touch panel 200 shown in FIG. 2B. FIG. 2C further illustrates a scan signal SCAN21, scan signal SCAN22 and data line Vdata2 which are received by another pixel structure 210, i.e., the pixel structure 210 intersected by the data line DL1 and scan line SCAN2.

First of all, when the pixel structure is not scanned from a time point t0 to a time point t1, the scan signal SCAN11, the scan signal SCAN12, the scan signal SCAN21, the scan signal SCAN22, the enable signal EN and the reference voltage signal VSS are held at the third voltage level VL1, in which the third voltage level may be a high voltage level as an example. When the pixel structure 210 is scanned at the time point t1, the scan signal SCAN11 becomes the fourth voltage level VL2, in which the fourth voltage level VL2 may be a low voltage level as an example. Meanwhile, the transistor 211 is turned on such that the initial voltage Vint is stored at the control terminal of the transistor 213.

In some embodiments, the initial voltage Vint may be the subtraction of the threshold voltage of the transmitter 213 from the voltage level on the first data line, in which the first data signal is the data signal corresponding to the highest light emitting luminance.

Subsequently, at the time point t2, the scan signal SCAN11 becomes the third voltage level VL1 such that the transistor 211 is turned off. At the same time, the scan signal SCAN12 becomes the fourth voltage level VL2, and the enable signal EN remains at the third voltage level VL1 such that the data signal Vdata1 corresponding to the present pixel structure 210 is transmitted to the transistor 213. Therefore, the data signal Vdata1 and the initial voltage Vint respectively received by the first terminal and the control terminal of the transistor 213 turn on the transistor 213. Moreover, since the control terminal of the transistor 212 has the fourth voltage level VL2, the transistor 212 is turned on such that the control terminal of the transistor 213 has the fifth voltage level, in which the fifth voltage level is the subtraction of the threshold voltage of the transistor 213 from the voltage level of the data signal Vdata1. As a result, the shift corresponding to the threshold voltage of the transmitter 213 is compensated.

In some embodiments, the time point when the scan signal SCAN11 becomes the third voltage level VL1 is earlier than the time point when the scan signal SCAN 12 becomes the fourth voltage level VL2.

At the time point t3, the scan signal SCAN 12 becomes the third voltage level VL1 so as to turn off the transistor 212. Meanwhile, since the reference signal VSS remains at the third voltage level VL1, the light emitting element 215 is still turned off. In addition, at the time point t3, another pixel structure 210 intersected by the data line DL1 and the scan line SCAN2 starts to operate similar to what has been done by the pixel structure 210 and the control circuit 220 between the time point t1 to the time point t2. In more details, the variations of the scan signal SCAN 21, of the scan signal SCAN22 and of the data signal Vdata2 after the time point t3 is similar to the variations of the scan signal SCAN11, of the scan signal SCAN12 and of the data signal Vdata1 between the time point t1 and the time point t3.

In some embodiments, when the third voltage level is the high voltage level, the third voltage level of the reference voltage signal VSS may be the highest voltage level of the data signal Vdata1 or the voltage level of the reference voltage signal VDD.

At last, at the time point t4, all the pixel structures 210 of the display panel 200 are finished being scanned, i.e., the pixel structure 210 intersected by the scan line SCANm and the data line DL1 are finished in the operation similar to those by the pixel structure 210 and the control circuit 220 in FIG. 2B between the time point t1 and the time point t3. The control terminal of the transistor 213 corresponding to each pixel structure 210 is stored with the corresponding voltage. In each pixel structure 210, the enable signal EN becomes the fourth voltage level VL2 so as to turn off the transistor 221 and to turn on the transistor 222, which transmits the reference voltage signal VDD to the transistor 213. Meanwhile, the reference voltage signal VSS became the fourth voltage threshold VL2, which turns on the transistor 213 and the light emitting diode 215. The light emitting element 215 generates the corresponding luminance according to the fifth voltage level of the control terminal of the transmitter 213.

In addition, example is made to the pixel structure shown in FIG. 2B. The current flowed through the light emitting element 215 is shown as the following equation. The current is substantially proportional to the square of the sixth voltage level, in which the sixth voltage level is subtraction of the threshold voltage $V_{th}$ of the transistor 213 from the voltage difference $V_{sg}$ of the first terminal and the control terminal of the transistor 213. The voltage difference $V_{sg}$ is the subtraction of the fifth voltage level from the voltage level of the reference voltage signal VDD, and the fifth voltage level is subtraction of the threshold voltage $V_{th}$ of the transistor 213 from the voltage level of the data signal Vdata1, which makes the sixth voltage level be the subtraction of the voltage level of the data signal Vdata1 from the voltage level of the reference voltage signal VDD. Therefore, the current flowed through the light emitting element 215 depends on the reference voltage signal VDD and the data signal Vdata1, and the variation of the threshold voltage $V_{th}$ corresponding to the transistor 213 does not affect the current flowed through the light emitting element 215, which makes the pixel structure 210 effectively compensate the shift of the threshold voltage.

$$I = \frac{1}{2}\beta(V_{sg} - |V_{th}|)^2 = \frac{1}{2}\beta(VDD - (Vdata1 - |V_{th}|) - |V_{th}|)^2 = \frac{1}{2}\beta(VDD - Vdata1)^2$$

Figure 3A:
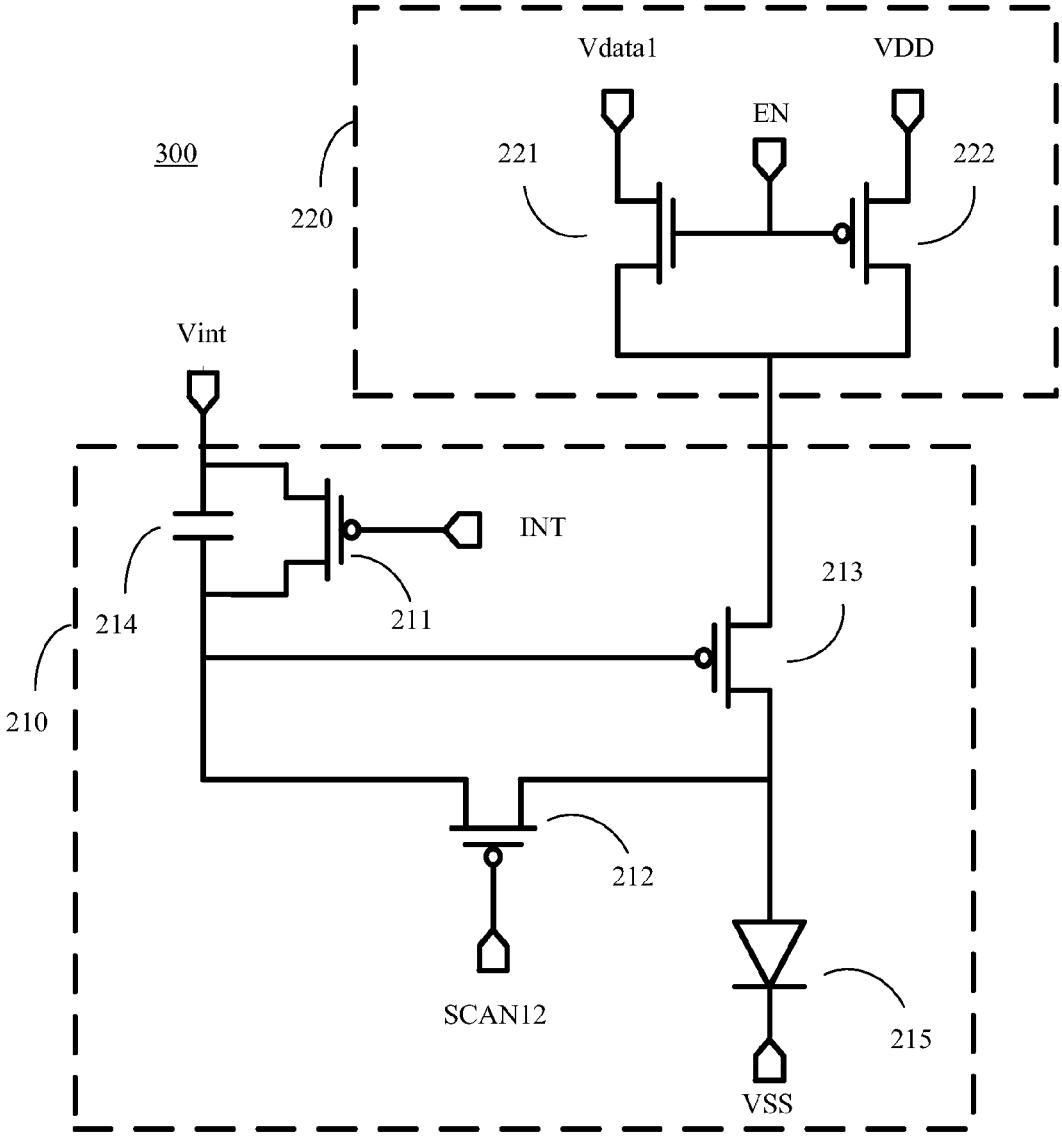
FIG. 3A is a circuit diagram illustrating a display panel according to one embodiment of the disclosure.
Figure 3B:
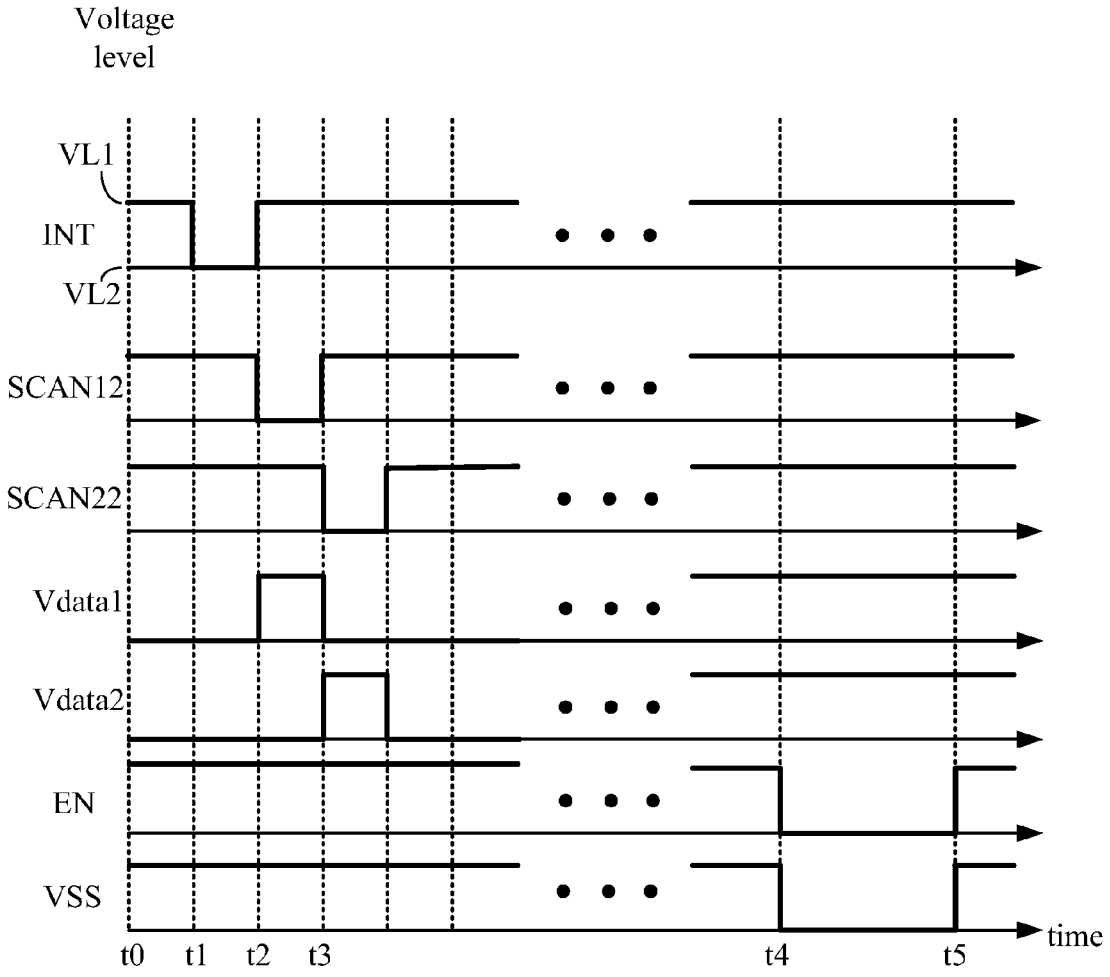
FIG. 3B is a timing diagram illustrating signals of the touch panel shown in FIG. 3A.

Referring to FIGS. 3A and 3B, FIG. 3A is a circuit diagram illustrating a display panel 300 according to one embodiment of the disclosure. FIG. 3A uses the pixel structure 210 at the upper-left corner in the FIG. 2A as an example, but it is not limited thereto. FIG. 3B is a timing diagram illustrating signals of the touch panel 300 shown in FIG. 3A, in which FIG. 3B further illustrates the scan signal SCAN21, scan signal SCAN22 and the data signal Vdata2 received by another pixel structure 210 intersected by the data line DL1 and the scan line SCAN2 in FIG. 2A. Compared to FIG. 2B, the control terminal of the transistor 211 in FIG. 3A is the initial signal INT, and the control terminal of the transistor 211 in FIG. 2B is the scan signal SCAN11. As shown in FIG. 2C and FIG. 3B, the scan signal SCAN11, the scan signal SCAN12 and the initial signal INT respectively set the control terminal of the transistor 213 corresponding to the pixel structure 210 in display panel 200 and display panel 300 as an initial voltage INT, in which each pixel structure 210 of the display panel 300 uses the same initial signal INT. However, the scan signal SCAN11 and the scan signal SCAN12 set the transistor 213 of the pixel structures 210 at different time points. In more details, there is a fixed time delay between the scan signal SCAN11 and the scan signal SCAN12 of the neighboring pixel structures 210. The initial signal INT sets the p-type transistor 213 of each pixel structure at the same time point. In other words, the initial signal INT sets each pixel structure 210 such that the control terminal of the transistor 213 corresponding to each pixel structure 210 is reset at the same time.

Figure 4A:
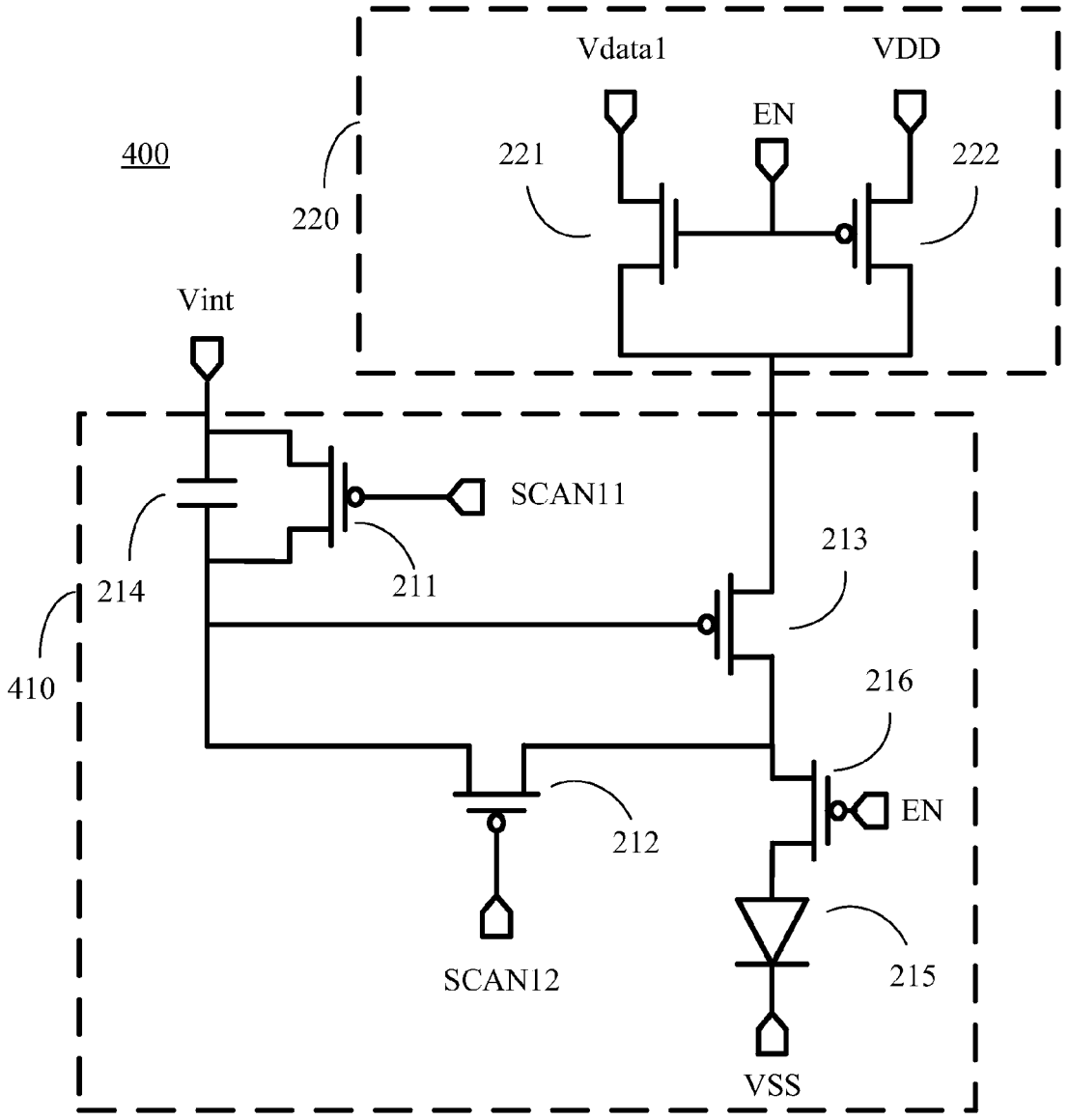
FIG. 4A is a circuit diagram illustrating a display panel according to one embodiment of the disclosure.
Figure 4B:
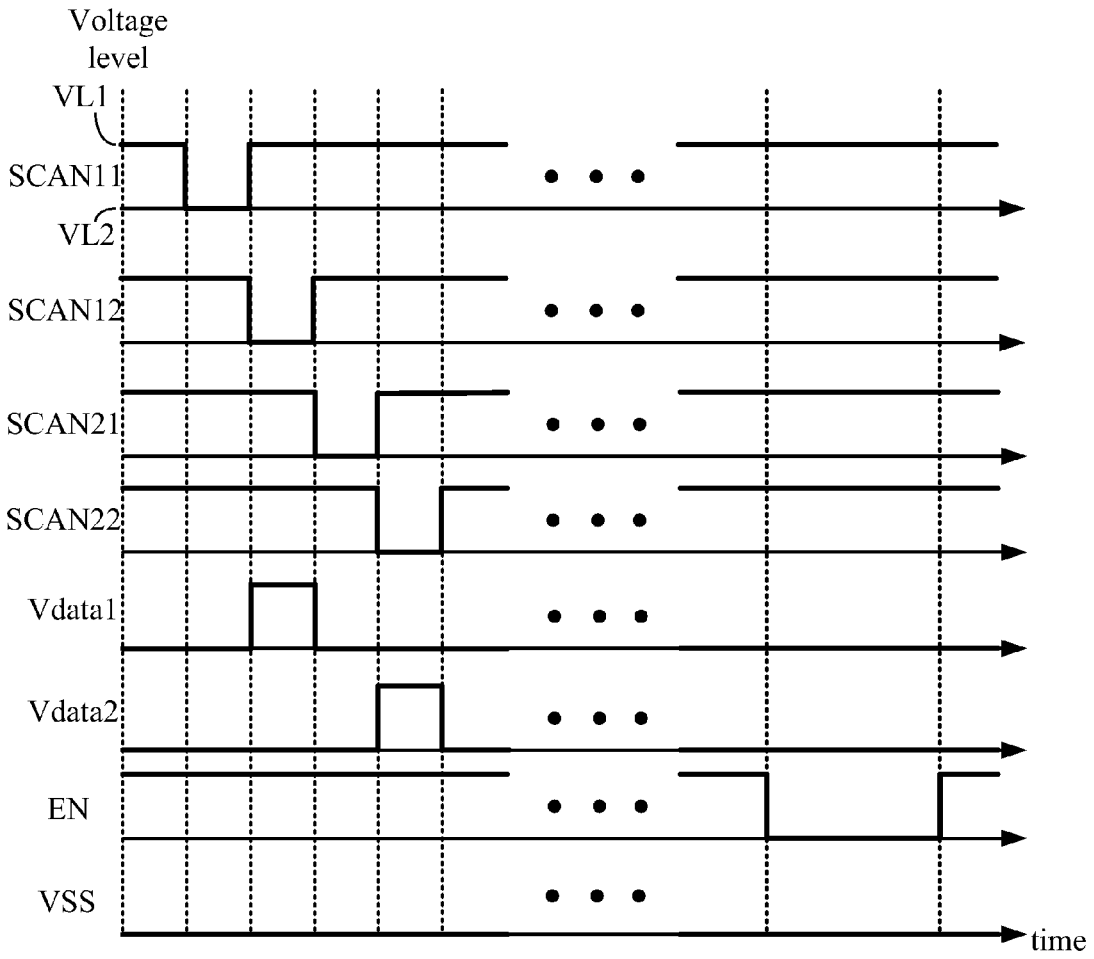
FIG. 4B is a timing diagram illustrating signals of the touch panel shown in FIG. 4A.

Referring to FIGS. 4A and 4B, FIG. 4A is a circuit diagram illustrating a display panel 400 according to one embodiment of the disclosure. It would be noted that the pixel structure 410 in FIG. 4A uses the pixel structure 210 at the upper-left corner in the FIG. 2A as an example, but it is not limited thereto. Compared to the pixel structure 210 shown in FIG. 2B, the difference is that the pixel structure 410 further includes the transistor 216, in which the transistor 216 may be a p-type transistor as an example. The transistor 216 is electrically coupled between the transistor 213 and the light emitting diode 215, in which the first terminal, e.g., the source terminal, and the second terminal, e.g., the drain terminal, of the transistor 216 are electrically coupled to the first terminal of the transistor 212 and the first terminal of the light emitting element 215. The control terminal, e.g., the gate terminal, of the transistor 216 is configured to receive the enable signal EN. In other words, when the enable signal has the enable voltage level, the transistor 216 is turned off so as to set the voltage of the control terminal of the transistor 213. When the enable signal EN is the non-enable voltage level, the transistor 216 and the transistor 222 are turned on such that the current flowed through the light emitting element 215 is determined according the voltage on the control terminal of the transistor 213, in which the enable voltage level may be a high voltage level as an example, and the non-enable voltage level may be a low voltage level as an example.

FIG. 4B is a timing diagram illustrating signals of the touch panel 400 shown in FIG. 4A. FIG. 4B further illustrates scan signal SCAN21, scan signal SCAN22 and the data signal Vdata2 received by another pixel structure 410, i.e., the pixel structure 210 intersected by the data line DL1 and the scan line SCAN2 in FIG. 2A. The driving mechanism is similar to that of the pixel structure 210 shown in FIG. 2B. However, since the transistor 216 can control the current flowed through the light emitting element 215, the reference voltage signal VSS is maintained at the fourth voltage level VL2, in which the fourth voltage level VL2 may be a low voltage level as an example.

Figure 5A:
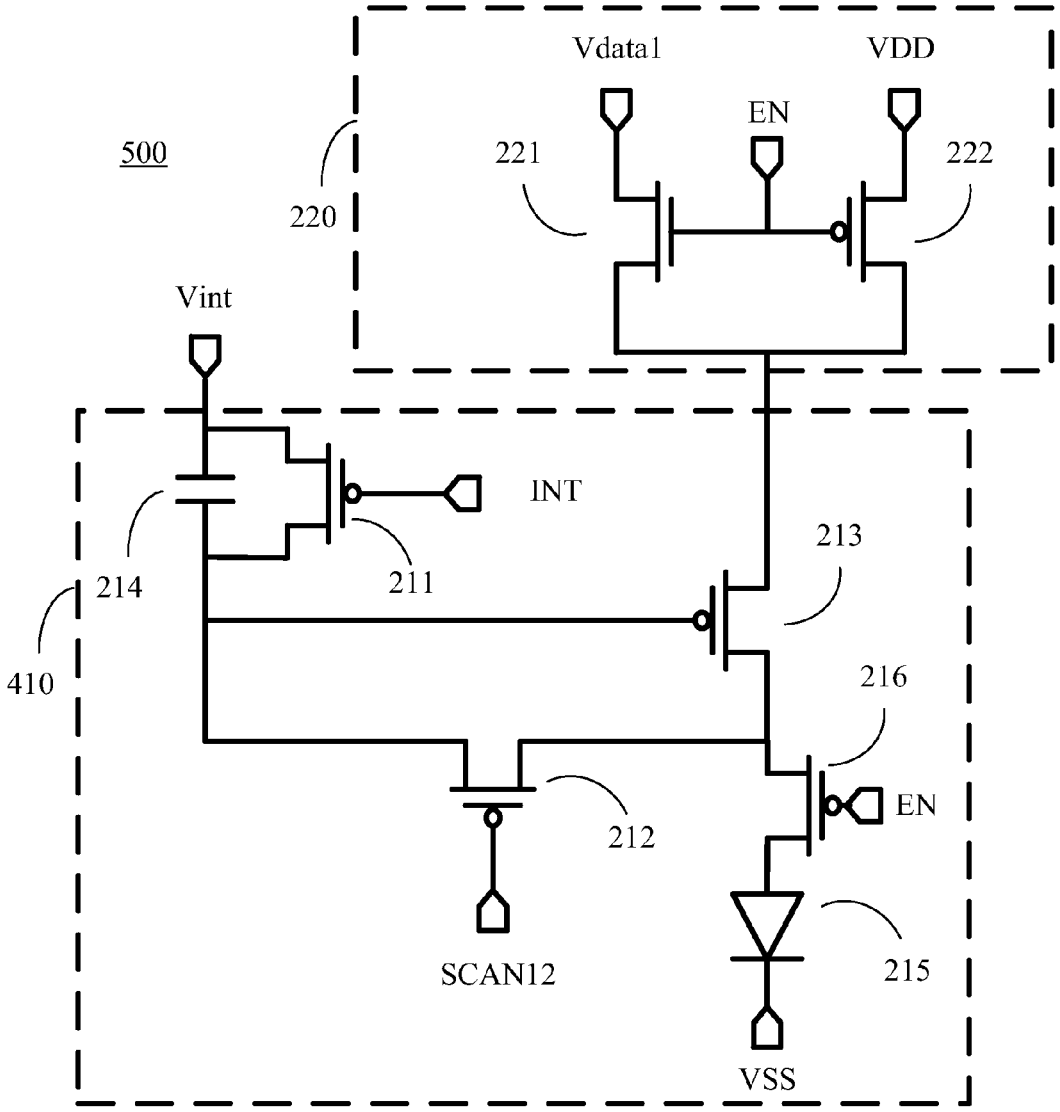
FIG. 5A is a circuit diagram illustrating a display panel according to one embodiment of the disclosure.
Figure 5B:
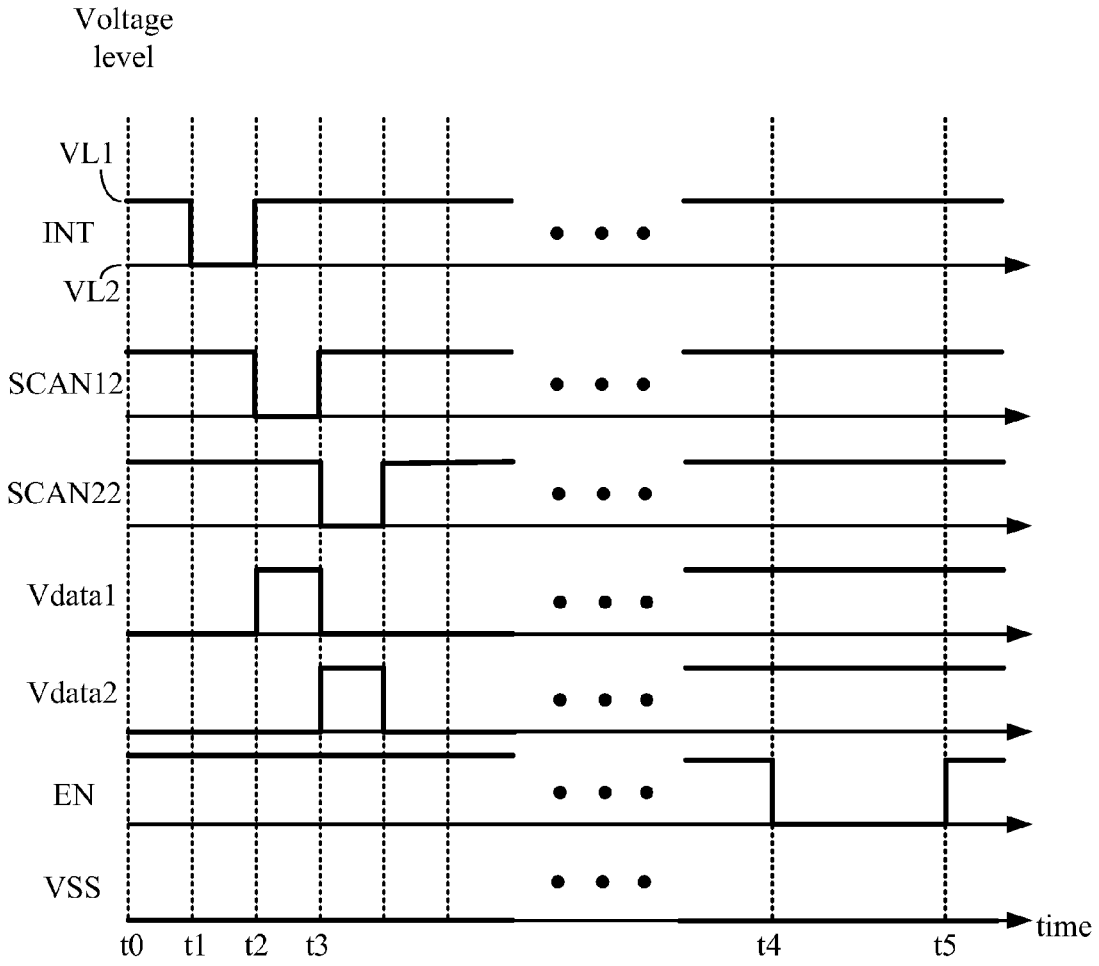
FIG. 5B is a timing diagram illustrating signals of the touch panel shown in FIG. 5A.

Referring to FIGS. 5A and 5B, FIG. 5A is a circuit diagram illustrating a display panel 500 according to one embodiment of the disclosure. The pixel structure 410 in FIG. 5A uses the pixel structure 210 at the upper-left corner in the FIG. 2A as an example, but it is not limited thereto. FIG. 5B is a timing diagram illustrating signals of the display panel 500 shown in FIG. 5A, and FIG. 5B further illustrates scan signal SCAN 21, the scan signal SCAN 22 and the data signal Vdata2 received by another pixel structure 410, i.e., the pixel structure 210 intersected by the data line DL1 and the scan line SCAN2 in FIG. 2A. Compared to FIG. 4A, the control terminal of the transistor 211 in FIG. 5A receives an initial signal INT, and the control terminal of the transistor 211 in FIG. 5A receives a scan signal SCAN11. As shown in FIG. 5A and FIG. 5B, the scan signal SCAN11, the scan signal SCAN12 and the initial signal INT respectively set the control terminals of the transistors 213 corresponding to the pixel structures 410 in the display panel 400 and in the display panel 500 as the initial voltage Vint. The scan signal SCAN11 and the scan signal SCAN12 set the initial voltage Vint at different time points. In more details, the scan signals of the neighboring pixel structure 410 have a fixed time delay. The initial signal INT sets initial voltage Vint of each pixel structure 410 at the same time point. The difference between the display panels in FIG. 5A and FIG. 4A is similar to that of the display panels in FIG. 3A and FIG. 2B.

Figure 6:
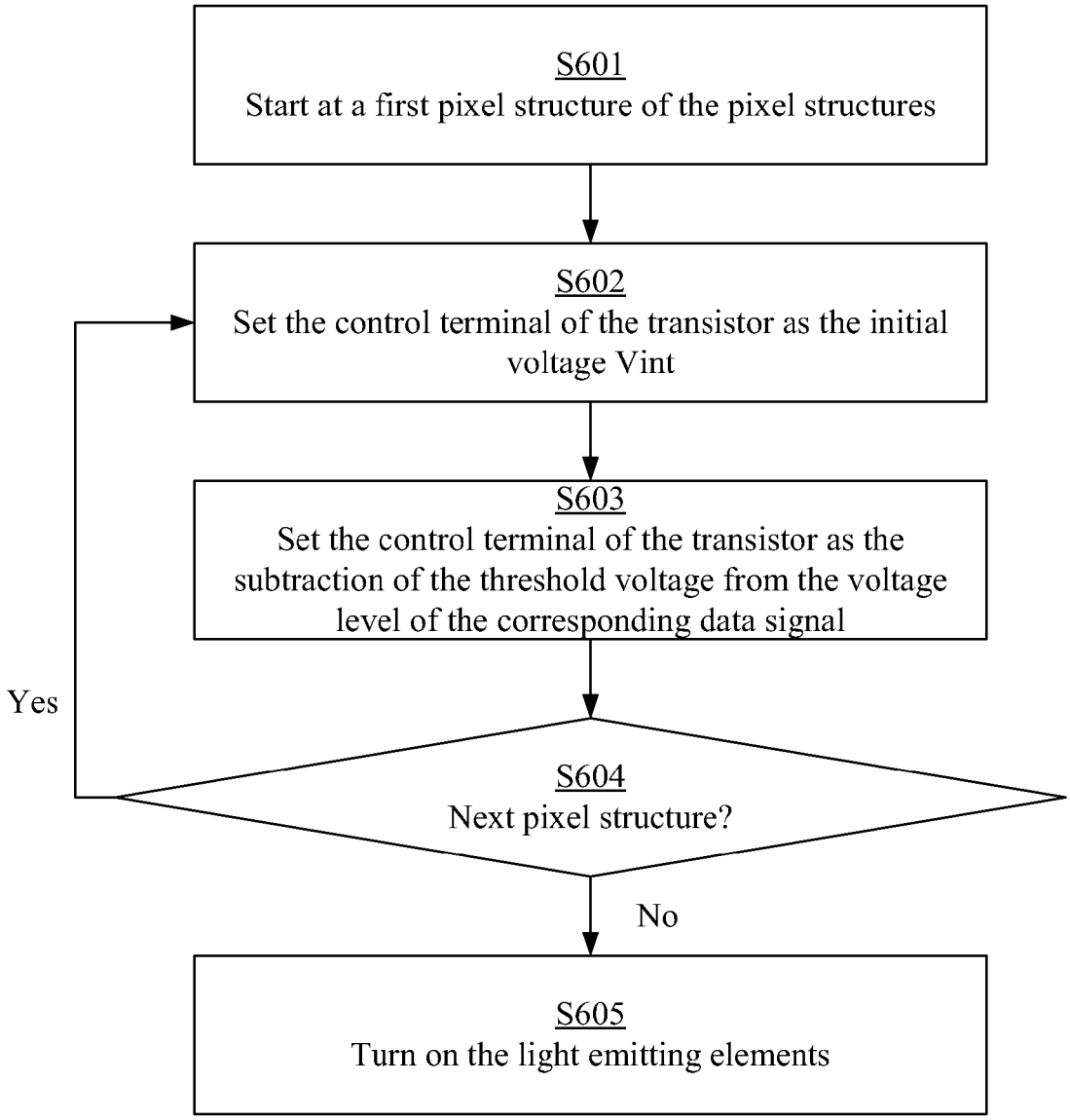
FIG. 6 is a flow diagram of the driving method according to one embodiment of the disclosure.

Referring to FIG. 6, a flow diagram of the driving method 600 according to one embodiment of the disclosure is presented so as to illustrate the driving flow of the display panels of the present disclosure. The display panel has multiple pixel structures, in which each of the pixel structures may be the pixel structure 210 shown in FIG. 2B or the pixel structure 410 shown in FIG. 4A.

First, in step S601, the flow starts at a first pixel structure of the pixel structures. In step S602, the control terminal of the transistor 213 in the first pixel structure is set as the initial voltage Vint. Subsequently, in step S603, the control terminal of the transistor 213 in the first pixel structure is set as the subtraction of the threshold voltage of the transistor 213 from the voltage level of the corresponding data signal Vdata1, and it is checked that whether the next pixel structure exists. If there is a next pixel structure, the flow goes back to step S602 to execute the step S602 and the step S603. If there is no next pixel structure, the flow goes to step S605 such that the light emitting diode 215 of each pixel structure is turned on, and the current corresponding to the data signal Vdata1 through the light emitting element 215 is generated.

In some embodiments, the first pixel structure may be the pixel structure on the first row.

In some embodiments, each pixel structure may be the pixel structure 210 in FIG. 3A or the pixel structure 410 in FIG. 5*a*. In step S602, the control terminal of the transistor 213 in each pixel structure is set as the initial voltage level. In step S604, if there is a next pixel structure, the flow goes back to step S603 so as to set the subtraction of the threshold voltage of the transistor 213 from the corresponding data signal Vdata1 at the control terminal of the transistor 213.

Based on those mentioned above, the present disclosure compared with other existing techniques has apparent advantages and beneficial results. The display panel provided by the present disclosure has less numbers of transistors and of capacitors, which effectively compensates the shift of the threshold voltage and reduces the production cost of each pixel structure.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the invention. In view of the foregoing, it is intended that the present disclosure cover modifications and variations of this disclosure provided they fall within the scope of the following claims.

What is claimed is:

1. A display panel, comprising:

a control circuit configured to selectively provide a data signal and a first reference voltage signal; and a pixel structure, comprising:

a capacitor;

a first switch unit, comprising a first terminal, a second terminal and a control terminal, wherein the first terminal and the second terminal of the first switch unit are electrically coupled to two terminals of the capacitor respectively, the first terminal of the first switch unit is configured to receive an initial voltage, and the control terminal of the first switch unit is configured to receive a control signal;

a second switch unit, comprising a first terminal, a second terminal and a control terminal, wherein the first terminal of the second switch unit is electrically coupled to the second terminal of the first switch unit, and the control terminal of the second switch unit is configured to receive a first scan signal; and a third switch unit, comprising a first terminal, a second terminal and a control terminal, wherein the first terminal of the third switch unit is configured to receive the data signal and the first reference voltage signal alternately, the second terminal of the third switch unit is electrically coupled to the second terminal of the second switch unit and to a first terminal of a light emitting element, and the control terminal of the third switch element is electrically coupled to the second terminal of the first switch unit, a voltage level on the control terminal of the third switch unit is configured substantially as a subtraction of a threshold voltage of the third switch unit from the data signal for compensating the variation as well as shifting of the threshold voltage corresponding to the third switch unit of the pixel structure.

2. The display panel of claim 1, wherein the display panel further comprises another pixel structure that is the same as the pixel structure, in which the control signal received by the control terminal of the first switch unit is a second scan signal; the second scan signal of the pixel structure and the second scan signal of the pixel structure are a same signal, or the second scan signal of the pixel structure has a fixed time delay compared to the second scan signal of the another pixel structure.

3. The display panel of claim 1, wherein the control circuit comprises:

a fourth switch unit, comprising a first terminal, a second terminal and a control terminal, wherein the first terminal of the fourth switch unit is configured to receive the data signal, the second terminal of the fourth switch unit is electrically coupled to the first terminal of the third switch unit, and the control terminal of the fourth switch unit is configured to receive an enable signal; and a fifth switch unit, comprising a first terminal, a second terminal and a control terminal, wherein the first terminal of the fifth switch unit is configured to received the first reference signal, the second terminal of the fifth switch unit is electrically coupled to the first terminal of the third switch unit, and the control terminal of the fifth switch unit is configured to receive the enable signal, wherein the fourth switch unit and the fifth switch unit are conducted in sequence according to the enable signal.

4. The display panel of claim 3, wherein one of the fourth switch unit and the fifth switch unit is a p-type transistor, and another one of the fourth switch unit and the fifth switch unit is a n-type transistor.

5. The display panel of claim 4, wherein a second terminal of the light emitting diode is configured to receive a second reference voltage signal, wherein the enable signal received by the fourth switch unit and the fifth switch unit is synchronized with the second reference voltage signal.

6. The display panel of claim 4, wherein the pixel structure further comprises a sixth switch unit, the sixth switch unit has a first terminal, a second terminal and a control terminal, in which the first terminal of the sixth switch unit is electrically coupled to the second terminal of the third switch unit, the second terminal of the sixth switch unit is electrically coupled to the first terminal of the lighting emitting element, the control terminal of the sixth switch unit is configured to receive the enable signal, and the fifth switch unit and the sixth switch unit are the same conducting p-type transistors.

7. The display panel of claim 3, wherein a second terminal of the light emitting diode is configured to receive a second reference voltage signal, wherein the enable signal received by the fourth switch unit and the fifth switch unit is synchronized with the second reference voltage signal.

8. The display panel of claim 3, wherein the pixel structure further comprises a sixth switch unit that has a first terminal, a second terminal and a control terminal, in which the first terminal of the sixth switch unit is electrically coupled to the second terminal of the third switch unit, the second terminal of the sixth switch unit is electrically coupled to the first terminal of the lighting element, the control terminal of the sixth switch unit is configured to receive the enable signal, and the fifth switch unit and the sixth switch unit are the same conducting p-type transistors.

9. A pixel driving method applied on the display panel of claim 1, comprising:

disconnecting a current transmission path from the third switch unit to the light emitting element;

conducting the first switch unit by the control signal, which makes the control terminal of the third switch unit has the initial voltage;

providing the data signal and the first reference voltage signal alternately to the first terminal of the third switch unit;

conducting the second switch unit by the first scan signal, and conducting the third switch unit by the data signal on the first terminal of the third switch unit and the initial voltage of the control terminal of the third switch unit such that the control terminal of the third switch unit generates a voltage difference according to the data signal and the threshold voltage of the third switch unit;

conducting the current transmission path from the third switch unit to the light emitting element; and conducting the third switch unit by the voltage difference and the first reference voltage signal so as to output an output current through the current transmission path to the light emitting element.

10. The pixel driving method of claim 9, wherein the control signal is a second scan signal, wherein an enabling period of the second scan signal is earlier than an enabling period of the first scan signal.

11. The pixel driving method of claim 9, wherein disconnecting the current transmission path further comprises:

pulling up a second reference voltage signal received by the light emitting element, or disconnecting a fourth switch unit electrically coupled to the light emitting element and the third switch unit by an enable signal.

12. The pixel driving method of claim 11, further comprising:

controlling the control circuit by the enable signal so as to selectively output the data signal and the first reference voltage signal.

13. The pixel driving method of claim 9, wherein conducting the current transmission path further comprises:

pulling down a second reference voltage signal electrically coupled to the light emitting element, or conducting a fourth switch unit electrically coupled to the light emitting element and to the third switch unit by an enable signal.

14. The pixel driving method of claim 13, further comprising:

controlling the control circuit by the enable signal so as to selectively output the data signal and the first reference voltage signal.

15. The display panel of claim 1, wherein the first terminal and the second terminal of the first switch unit are directly coupled to two terminals of the capacitor.

16. The display panel of claim 1, wherein the second terminal of the first switch unit is directly coupled to the control terminal of the third switch unit.

17. The display panel of claim 1, wherein the first switch unit is configured to be turned on and deliver the initial voltage, which is received by the first terminal of the first switch unit and by a first terminal of the first capacitor, to the control terminal of the third switch unit and to a second terminal of the first capacitor.

18. The display panel of claim 1, wherein the second switch unit is configured to be turned on when the first terminal of the third switch unit receives the data signal.

19. A display panel, comprising:

a control circuit configured to selectively provide a data signal and a first reference voltage signal; and a pixel structure, comprising:

a capacitor;

a first switch unit, comprising a first terminal, a second terminal and a control terminal, wherein the first terminal and the second terminal of the first switch unit are electrically coupled to two terminals of the capacitor respectively, the first terminal of the first switch unit is configured to receive an initial voltage, and the control terminal of the first switch unit is configured to receive a control signal;

a second switch unit, comprising a first terminal, a second terminal and a control terminal, wherein the first terminal of the second switch unit is electrically coupled to the second terminal of the first switch unit, and the control terminal of the second switch unit is configured to receive a first scan signal; and a third switch unit, comprising a first terminal, a second terminal and a control terminal, wherein the first terminal of the third switch unit is configured to receive the data signal and the first reference voltage signal alternately, the second terminal of the third switch unit is electrically coupled to the second terminal of the second switch unit and to a first terminal of a light emitting element, and the control terminal of the third switch element is electrically coupled to the second terminal of the first switch unit, a voltage level on the control terminal of the third switch unit is configured substantially as a subtraction of a threshold voltage of the third switch unit from the data signal for compensating the variation as well as shifting of the threshold voltage corresponding to the third switch unit of the pixel structure;

wherein the second switch unit is configured to be turned on when the first terminal of the third switch unit receives the data signal.

* * * * *